US007202654B1

(12) United States Patent
Dadashev et al.

(10) Patent No.: US 7,202,654 B1
(45) Date of Patent: Apr. 10, 2007

(54) DIODE STACK HIGH VOLTAGE REGULATOR

(75) Inventors: Oleg Dadashev, Hadera (IL); Alexander Kushnarenko, Haifa (IL)

(73) Assignee: Saifun Semiconductors Ltd, Netanya (IL)

( * ) Notice: Subject to any disclaimer, the term of this patent is extended or adjusted under 35 U.S.C. 154(b) by 0 days.

(21) Appl. No.: 11/236,359

(22) Filed: Sep. 27, 2005

(51) Int. Cl.
*G05F 3/16* (2006.01)

(52) U.S. Cl. ..... 323/315; 323/316; 323/280

(58) Field of Classification Search ..... 323/312, 323/313, 314, 315, 316, 280, 281
See application file for complete search history.

(56) References Cited

U.S. PATENT DOCUMENTS 5,483,150 A * 1/1996 Elliott et al. ..... 323/312
5,783,934 A * 7/1998 Tran ..... 323/312
6,861,831 B2 * 3/2005 Ngiap Ho ..... 323/315

* cited by examiner

*Primary Examiner*—Jessica Han
(74) *Attorney, Agent, or Firm*—Eitan Law Group

(57) ABSTRACT

A high voltage regulator including a current mirror including a pair of transistors, one of the transistors being connected to a node that outputs an output voltage $V_{out}$, a diode stack that includes a plurality of serially connected transistors $T_0$, $T_1$, $T_2$, . . . $T_n$, wherein the transistor $T_1$ is connected to a node $n_0$, to which is connected another transistor $T_0$ that receives an input bias voltage $V_{bias}$, and wherein a feedback voltage fb from node $n_0$ is fed to an input of the differential amplifier, the differential amplifier receiving an input reference voltage $V_{ref}$ at one of its other inputs, and is also connected to positive voltage supply Vdd, the differential amplifier outputting to an NMOS transistor M, and wherein the high voltage regulator has a large diode stack gain and lower $G_{DA}*G_{NMOS}*m$, resulting in a generally constant feedback (loop) gain $G_{loop}$, wherein the loop gain is given by:

$$\text{Loop Gain}=G_{loop}=G_{stack}*G_{DA}*G_{NMOS}*m$$

wherein m is the ratio of the two currents $I_1$ and $I_2$, that is, $I_2=mI_1$, $G_{stack}$ is the gain of the diode stack, $G_{DA}$ is the gain of the differential amplifier and $G_{NMOS}$ is the gain of the NMOS transistor M.

9 Claims, 2 Drawing Sheets

DIODE STACK HIGH VOLTAGE REGULATOR

FIELD OF THE INVENTION

The present invention relates generally to voltage regulators, and particularly to a high voltage regulator with a diode stack instead of a divider, e.g., a resistor or capacitor divider.

BACKGROUND OF THE INVENTION

Non-volatile memory (NVM) arrays, such as erasable, programmable read only memory (EPROM) or flash memory arrays, or electrically erasable, programmable read only memory (EEPROM) arrays, require high positive or negative voltages to program and erase memory cells of the array.

Read and write operations are typically carried out with voltages that are regulated above a positive voltage supply Vdd. The circuitry that supplies and controls the programming and verification voltages generally comprises a high voltage regulator or high voltage pump (the terms being used herein interchangeably). A typical high voltage regulator architecture is shown in FIG. 1.

A current mirror including a pair of PMOS (p-channel metal oxide semiconductor) transistors 4 and 5 have their gates connected to each other and their sources connected to a high voltage supply $V_{hv_supply}$. The gate of transistor 4 is connected to its drain. The current through transistor 4 is $I_1$ and the current through transistor 5 is $I_2$. The drain of transistor 5 is connected via a node n to $V_{out}$ and to a divider 6 comprising a pair of serially connected circuit elements $B_1$ and $B_2$, e.g., resistors, diodes or capacitors. Divider 6 passes a feedback voltage fb to one of the inputs of a voltage amplifier (also called a differential stage or differential amplifier) 7. Differential amplifier 7 receives an input reference voltage $V_{ref}$ at one of its other inputs, and is also connected to positive voltage supply Vdd. The output of differential amplifier 7 may be connected to the gate of an NMOS (n-channel metal oxide semiconductor) transistor M. The drain of transistor M is connected to the drain of transistor 4, and the source of transistor M is connected to ground.

The open loop gain ($G_{loop}$) of the high voltage regulator of FIG. 1 (i.e., the ratio of the output voltage to the differential input voltage without any external feedback) is given by:

$$\text{Loop Gain}=G_{loop}=G_{divider}*G_{DA}*G_{NMOS}*m$$

wherein m is the ratio of the two currents $I_1$ and $I_2$, that is, $I_2=mI_1$

The feedback voltage $V_{fb}$ is approximately equal to the reference voltage $V_{ref}$ ($V_{fb}\approx V_{ref}$)

In the case of divider 6 comprising a pair of serially connected resistors, the following relations hold:

$$\Delta V_{fb}=G_{divider}*\Delta V_{out}=(R_{B1}+R_{B2})/R_{B2}*\Delta V_{out}$$

$$V_{out}=(R_{B1}+R_{B2})/R_{B2}*V_{fb}\approx(R_{B1}+R_{B2})/R_{B2}*V_{ref}$$

There is an inherent stability problem with the prior art voltage regulator of FIG. 1, because a high loop gain (although having a fast recovery time) leads to instability of the regulator. On the other hand, a low loop gain results in a slow recovery time. In the case of a resistor divider, there may be a problem of parasitic capacitance to ground of the resistors, leading to another stability/recovery time problem.

An additional capacitor divider problem is that of parasitic capacitance to ground which adversely affects the accuracy of $V_{out}$. An additional diode divider problem is that it is not possible to have an arbitrary $V_{out}$ without significantly changing $I_2$.

SUMMARY OF THE INVENTION

The present invention seeks to provide a novel high voltage regulator with a diode stack, as is described more in detail hereinbelow. The present invention may have a large diode stack gain (=1) but lower $G_{DA}*G_{NMOS}*m$, resulting in a generally constant feedback (loop) gain $G_{loop}$. The invention has lower feedback delay, better stability and faster recovery time than the prior art.

There is thus provided in accordance with an embodiment of the present invention circuitry including a voltage regulator including a current mirror including a pair of transistors, one of the transistors being connected to a node that outputs an output voltage $V_{out}$, a diode stack that includes a plurality of serially connected transistors $T_0$, $T_1$, $T_2$, . . . $T_n$, wherein the transistor $T_1$ is connected to a node $n_0$, to which is connected another transistor $T_0$ that receives an input bias voltage $V_{bias}$, and wherein a feedback voltage fb from node $n_0$ is fed to an input of the differential amplifier, the differential amplifier receiving an input reference voltage $V_{ref}$ at one of its other inputs, and is also connected to positive voltage supply Vdd, the differential amplifier outputting to an NMOS transistor M, and wherein the high voltage regulator has a large diode stack gain and lower $G_{DA}*G_{NMOS}*m$, resulting in a generally constant feedback (loop) gain $G_{loop}$, wherein the loop gain is given by:

$$\text{Loop Gain}=G_{loop}=G_{stack}*G_{DA}*G_{NMOS}*m$$

wherein m is the ratio of the two currents $I_1$ and $I_2$, that is, $I_2=mI_1$, $G_{stack}$ is the gain of the diode stack, $G_{DA}$ is the gain of the differential amplifier and $G_{NMOS}$ is the gain of the NMOS transistor M.

In accordance with an embodiment of the present invention $\Delta V_{fb}=G_{stack}*\Delta V_{out}$.

Further in accordance with an embodiment of the present invention $V_{out}=V_{fb}+n*V_{bias}\approx V_{ref}+n*V_{bias}$, and $G_{stack}\approx 1$. The gates of the transistors of the current mirror may be connected to each other and their sources may be connected to a high voltage supply The serially connected transistors may include NMOS transistors. The transistors of the current mirror may include PMOS transistors.

There is also provided in accordance with an embodiment of the present invention a high voltage regulator including a current mirror including a pair of PMOS transistors that have their gates connected to each other and their sources connected to a high voltage supply, wherein current through one of the PMOS transistors is $I_1$ and the current through the other PMOS transistor is $I_2$, wherein the current $I_1$ flows to a drain of an NMOS transistor M whose gate is connected to an output of a differential amplifier, wherein gates of the PMOS transistors of the current mirror are connected to each other and their sources are connected to a high voltage supply, and wherein the current $I_2$ flows to a diode stack that includes a plurality of serially connected NMOS transistors $T_0$, $T_1$, $T_2$, . . . $T_n$, wherein a drain of transistor $T_n$ is connected to a drain of the PMOS transistor through which flows current $I_2$, and wherein a gate of transistor $T_n$ is connected to its drain and a source of transistor $T_n$ is connected to its bulk and to a drain of adjacent NMOS transistor $T_{n-1}$ and wherein a source of NMOS transistor $T_0$ is connected to a node $n_0$, which is connected to a drain of NMOS transistor $T_0$, wherein a gate of NMOS transistor $T_0$ receives an input bias voltage $V_{bias}$ and a source of NMOS transistor $T_0$ is connected to its bulk and to ground, and wherein a feedback voltage from node $n_0$ is fed to an input of the differential amplifier, the differential amplifier receiving an input reference voltage $V_{ref}$ at one of its other inputs, and is also connected to positive voltage supply Vdd, wherein the feedback voltage is approximately equal to the reference voltage $V_{ref}$ and a gate-source voltage of the diode stack is approximately equal to the bias voltage, and wherein the high voltage regulator may has a large diode stack gain but lower $G_{DA}*G_{NMOS}*m$, resulting in a generally constant feedback (loop) gain $G_{loop}$, wherein the loop gain is given by:

$$\text{Loop Gain}=G_{loop}=G_{stack}*G_{DA}*G_{NMOS}*m$$

wherein m is the ratio of the two currents $I_1$ and $I_2$, that is, $I_2=mI_1$ $$\Delta V_{fb}=G_{stack}*\Delta V_{out} \text{ and}$$

$$V_{out}=V_{fb}+n*V_{bias}\approx V_{ref}+n*V_{bias}. \text{ (}G_{stack}\text{ may be approximately equal to 1)}$$

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
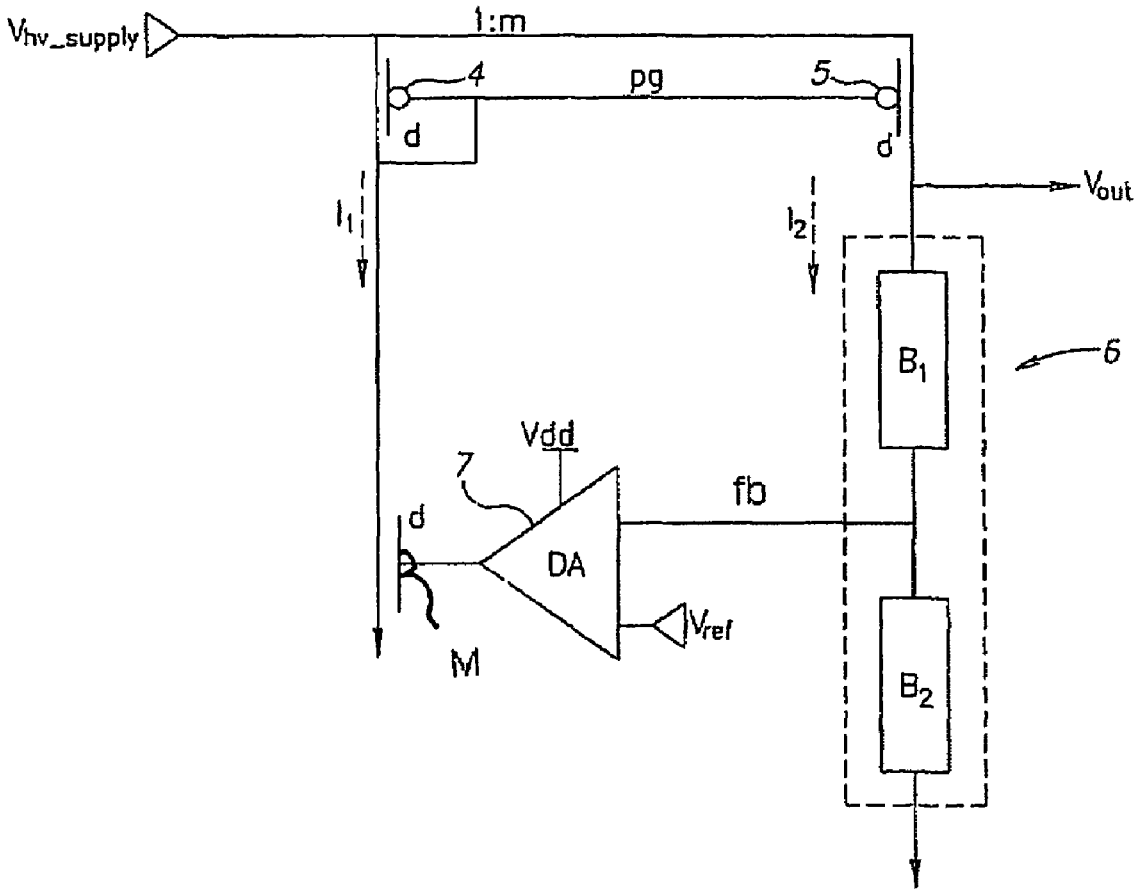
FIG.1 PRIOR ART
FIG. 1 is a simplified block diagram of a typical prior art high voltage regulator architecture.
Figure 2:
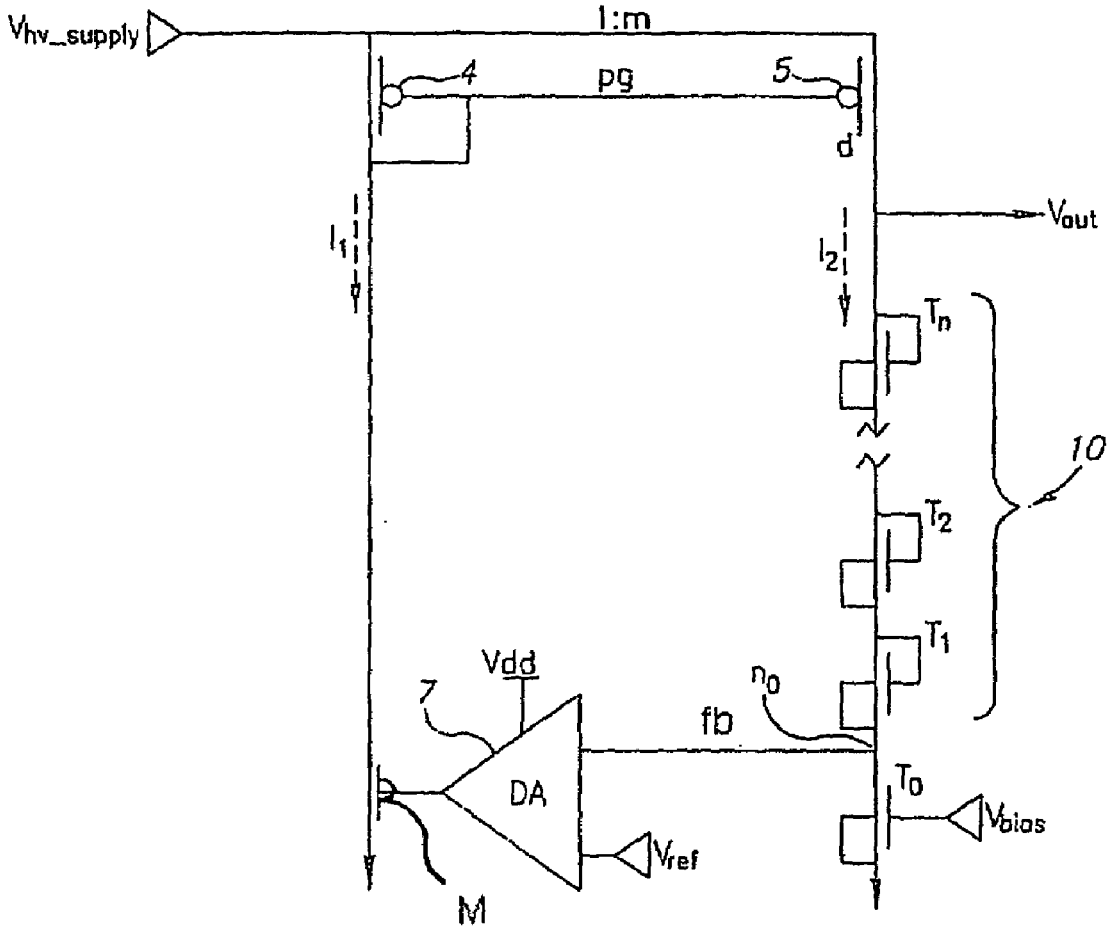
FIG. 2 is a simplified block diagram of a high voltage regulator architecture, in accordance with an embodiment of the present invention.

Reference is now made to FIG. 2, which illustrates a simplified block diagram of a high voltage regulator, in accordance with an embodiment of the present invention. Components of the circuitry of FIG. 2 that are similar to that of FIG. 1 are designated with the same reference labels, and the description is not repeated for the sake of brevity.

The divider 6 of the architecture of FIG. 1 is replaced in the non-limiting embodiment of FIG. 2 with a diode stack 10. Diode stack 10 may include a plurality of serially connected NMOS transistors $T_0, T_1, T_2, \ldots T_n$. The drain of transistor $T_n$ is connected to the drain of PMOS transistor 5. The gate of transistor $T_n$ is connected to its drain. The source of transistor $T_n$ is connected to its bulk and to the drain of the next NMOS transistor $T_{n-1}$. The source of transistor $T_1$ is connected to node $n_0$. The drain of another NMOS transistor $T_0$ is connected to node $n_0$. The gate of transistor $T_0$ receives an input $V_{bias}$. The source of transistor $T_0$ is connected to its bulk and to ground.

In the high voltage regulator of the present invention, as with the prior art, the open loop gain ($G_{loop}$) is again given by:

$$\text{Loop Gain}=G_{loop}=G_{stack}*G_{DA}*G_{NMOS}*m$$

wherein m is the ratio of the two currents $I_1$ and $I_2$, that is, $I_2=mI_1$

The gate-source voltage of the diode stack 10 ($V_{gs}$) is approximately equal to the bias voltage $V_{bias}$ ($V_{gs}\approx V_{bias}$). As with the prior art, The feedback voltage $V_{fb}$ is approximately equal to the reference voltage $V_{ref}$ ($V_{fb}\approx V_{ref}$).

The high voltage regulator may have a large diode stack gain (=1) but lower $G_{DA}*G_{NMOS}*m$, resulting in a generally constant feedback (loop) gain $G_{loop}$.

$$\Delta V_{fb}=G_{stack}*\Delta V_{out} \text{(wherein } G_{stack}=1)$$

$$V_{out}=V_{fb}+n*V_{bias}\approx V_{ref}+n*V_{bias}$$

It will be appreciated by person skilled in the art, that the present invention is not limited by what has been particularly shown and described herein above. Rather the scope of the present invention is defined only by the claims that follow:

What is claimed is:

1. A high voltage regulator comprising:

a current mirror comprising a pair of transistors, one of the transistors being connected to a node that outputs an output voltage $V_{out}$;

a diode stack that comprises a plurality of serially connected transistors $T_0, T_1, T_2, \ldots T_n$, wherein said transistor $T_1$ is connected to a node $n_0$, to which is connected another transistor $T_0$ that receives an input bias voltage $V_{bias}$, and wherein a feedback voltage fb from node $n_0$ is fed to an input of the differential amplifier, said differential amplifier receiving an input reference voltage $V_{ref}$ at one of its other inputs, and is also connected to positive voltage supply Vdd, said differential amplifier outputting to an NMOS transistor M, and wherein said high voltage regulator has a large diode stack gain and lower $G_{DA}*G_{NMOS}*m$, resulting in a generally constant feedback (loop) gain $G_{loop}$, wherein said loop gain is given by:

$$\text{Loop Gain}=G_{loop}=G_{stack}*G_{DA}*G_{NMOS}*m$$

wherein m is the ratio of the two currents $I_1$ and $I_2$, that is, $I_2=mI_1$, $G_{stack}$ is the gain of said diode stack, $G_{DA}$ is the gain of said differential amplifier and $G_{NMOS}$ is the gain of said NMOS transistor M.

2. The high voltage regulator according to claim 1, wherein $\Delta V_{fb}=G_{stack}*\Delta V_{out}$.

3. The high voltage regulator according to claim 1, wherein $V_{out}=V_{fb}+n*V_{bias}\approx V_{ref}+n*V_{bias}$.

4. The high voltage regulator according to claim 1, wherein $G_{stack}\approx 1$.

5. The high voltage regulator according to claim 1, wherein gates of the transistors of the current mirror are connected to each other and their sources are connected to a high voltage supply.

6. The high voltage regulator according to claim 1, wherein the serially connected transistors comprise NMOS transistors.

7. The high voltage regulator according to claim 1, wherein the transistors of said current mirror comprise PMOS transistors.

8. A high voltage regulator comprising:

a current mirror comprising a pair of PMOS transistors that have their gates connected to each other and their sources connected to a high voltage supply, wherein current through one of the PMOS transistors is $I_1$ and the current through the other PMOS transistor is $I_2$, wherein the current $I_1$ flows to a drain of an NMOS transistor M whose gate is connected to an output of a differential amplifier;

wherein gates of the PMOS transistors of the current mirror are connected to each other and their sources are connected to a high voltage supply;

and wherein the current $I_2$ flows to a diode stack that comprises a plurality of serially connected NMOS transistors $T_0$, $T_1$, $T_2$, . . . $T_n$, wherein a drain of transistor $T_n$ is connected to a drain of the PMOS transistor through which flows current $I_2$, and wherein a gate of transistor $T_n$ is connected to its drain and a source of transistor $T_n$ is connected to its bulk and to a drain of adjacent NMOS transistor $T_{n-1}$, and wherein a source of NMOS transistor $T_1$ is connected to a node $n_0$, which is connected to a drain of NMOS transistor $T_0$, wherein a gate of NMOS transistor $T_0$ receives an input bias voltage $V_{bias}$ and a source of NMOS transistor $T_0$ is connected to its bulk and to ground, and wherein a feedback voltage from node $n_0$ is fed to an input of the differential amplifier, said differential amplifier receiving an input reference voltage $V_{ref}$ at one of its other inputs, and is also connected to positive voltage supply Vdd, wherein said feedback voltage is approximately equal to the reference voltage $V_{ref}$ and a gate-source voltage of said diode stack is approximately equal to said bias voltage, and wherein said high voltage regulator may has a large diode stack gain but lower $G_{DA}*G_{NMOS}*m$, resulting in a generally constant feedback (loop) gain $G_{loop}$, wherein said loop gain is given by:

$$\text{Loop Gain}=G_{loop}=G_{stack}*G_{DA}*G_{NMOS}*m$$

wherein m is the ratio of the two currents $I_1$ and $I_2$, that is, $I_2=mI_1$ $$\Delta V_{fb}=G_{stack}*\Delta V_{out} \text{ and}$$

$$V_{out}=V_{fb}+n*V_{bias}\approx V_{ref}+n*V_{bias}.$$

9. The high voltage regulator according to claim 8, wherein $G_{stack}\approx 1$.

* * * * *